US006733542B1

(12) United States Patent
Fort

(10) Patent No.: US 6,733,542 B1
(45) Date of Patent: May 11, 2004

(54) METHOD FOR DARKENING BLACK CLOTHING

(76) Inventor: Terri J. Fort, 327 S. Wisconsin Ave., #3 A, Oak Park, IL (US) 60302

( * ) Notice: Subject to any disclaimer, the term of this patent is extended or adjusted under 35 U.S.C. 154(b) by 232 days.

(21) Appl. No.: 09/960,058

(22) Filed: Sep. 21, 2001

(51) Int. Cl.[7] ..... D06P 1/673
(52) U.S. Cl. ..... 8/441; 8/527; 8/618
(58) Field of Search ..... 8/441, 527, 618

(56) References Cited

U.S. PATENT DOCUMENTS 1,752,184 A * 3/1930 Kritchevsky et al.
3,928,252 A 12/1975 Rigler et al.
4,408,997 A * 10/1983 Perrig
4,427,566 A 1/1984 Clements
5,486,228 A 1/1996 Miller et al.
5,601,689 A 2/1997 Sacripante et al.
5,665,124 A * 9/1997 Jager et al.
5,707,534 A 1/1998 Del Corral et al.
5,858,024 A 1/1999 De Lacharriere et al.

OTHER PUBLICATIONS www.RIt.com (Rit website), copyright 2003, "The abc's of dyeing" and "Tips for True Color".*

* cited by examiner

*Primary Examiner*—Margaret Einsmann

(57) ABSTRACT

A method for darkening black clothing for darkening faded black clothing and for preventing the fading of black clothing. The method for darkening black clothing includes a quantity of black dye, a quantity of sodium chloride salt, and a quantity of water. The black dye, the salt and the water are mixed together to define a mixture. The mixture in a container for later use in darkening clothing.

8 Claims, 1 Drawing Sheet

METHOD FOR DARKENING BLACK CLOTHING

BACKGROUND OF THE INVENTION

1. Field of the Invention

The present invention relates to methods of dying cloth and more particularly pertains to a new method for darkening black clothing for darkening faded black clothing and for preventing the fading of black clothing.

2. Description of the Prior Art

The use of methods of dying cloth is known in the prior art. More specifically, methods of dying cloth heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,601,689; U.S. Pat. No. 5,858,024; U.S. Pat. No. 4,427,566; U.S. Pat. No. 5,707,534; U.S. Pat. No. 3,928,252; and U.S. Pat. No. 5,486,228.

While these devices fulfill their respective, particular objectives and requirements, the aforementioned patents do not disclose a new method for darkening black clothing. The inventive device includes providing a quantity of black dye, a quantity of sodium chloride salt, and a quantity of water. The black dye, the salt and the water are mixed together to define a mixture. The mixture in a container for later use in darkening clothing.

In these respects, the method for darkening black clothing according to the present invention substantially departs from the conventional concepts and designs of the prior art, and in so doing provides an apparatus primarily developed for the purpose of darkening faded black clothing and for preventing the fading of black clothing.

SUMMARY OF THE INVENTION

In view of the foregoing disadvantages inherent in the known types of methods of dying cloth now present in the prior art, the present invention provides a new method for darkening black clothing construction wherein the same can be utilized for darkening faded black clothing and for preventing the fading of black clothing.

The general purpose of the present invention, which will be described subsequently in greater detail, is to provide a new method for darkening black clothing which has many of the advantages of the methods of dying cloth mentioned heretofore and many novel features that result in a new method for darkening black clothing which is not anticipated, rendered obvious, suggested, or even implied by any of the prior art methods of dying cloth, either alone or in any combination thereof.

To attain this, the present invention generally comprises a quantity of black dye, a quantity of sodium chloride salt, and a quantity of water. The black dye, the salt and the water are mixed together to define a mixture. The mixture in a container for later use in darkening clothing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method for darkening black clothing which has many of the advantages of the methods of dying cloth mentioned heretofore and many novel features that result in a new method for darkening black clothing which is not anticipated, rendered obvious, suggested, or even implied by any of the prior art methods of dying cloth, either alone or in any combination thereof.

It is another object of the present invention to provide a new method for darkening black clothing which may be easily and efficiently manufactured and marketed.

It is a further object of the present invention to provide a new method for darkening black clothing which is of a durable and reliable construction.

An even further object of the present invention is to provide a new method for darkening black clothing which is susceptible of a low cost of manufacture with regard to both materials and labor, and which accordingly is then susceptible of low prices of sale to the consuming public, thereby making such method for darkening black clothing economically available to the buying public.

Still yet another object of the present invention is to provide a new method for darkening black clothing which provides in the methods of the prior art some of the advantages thereof, while simultaneously overcoming some of the disadvantages normally associated therewith.

Still another object of the present invention is to provide a new method for darkening black clothing for darkening faded black clothing and for preventing the fading of black clothing.

Yet another object of the present invention is to provide a new method for darkening black clothing which includes a quantity of black dye, a quantity of sodium chloride salt, and a quantity of water. The black dye, the salt and the water are mixed together to define a mixture. The mixture in a container for later use in darkening clothing.

Still yet another object of the present invention is to provide a new method for darkening black clothing that is conveniently used as a substitute for bleach when a person is washing black clothes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawing wherein.

DESCRIPTION OF THE PREFERRED EMBODIMENT

Figure 1:
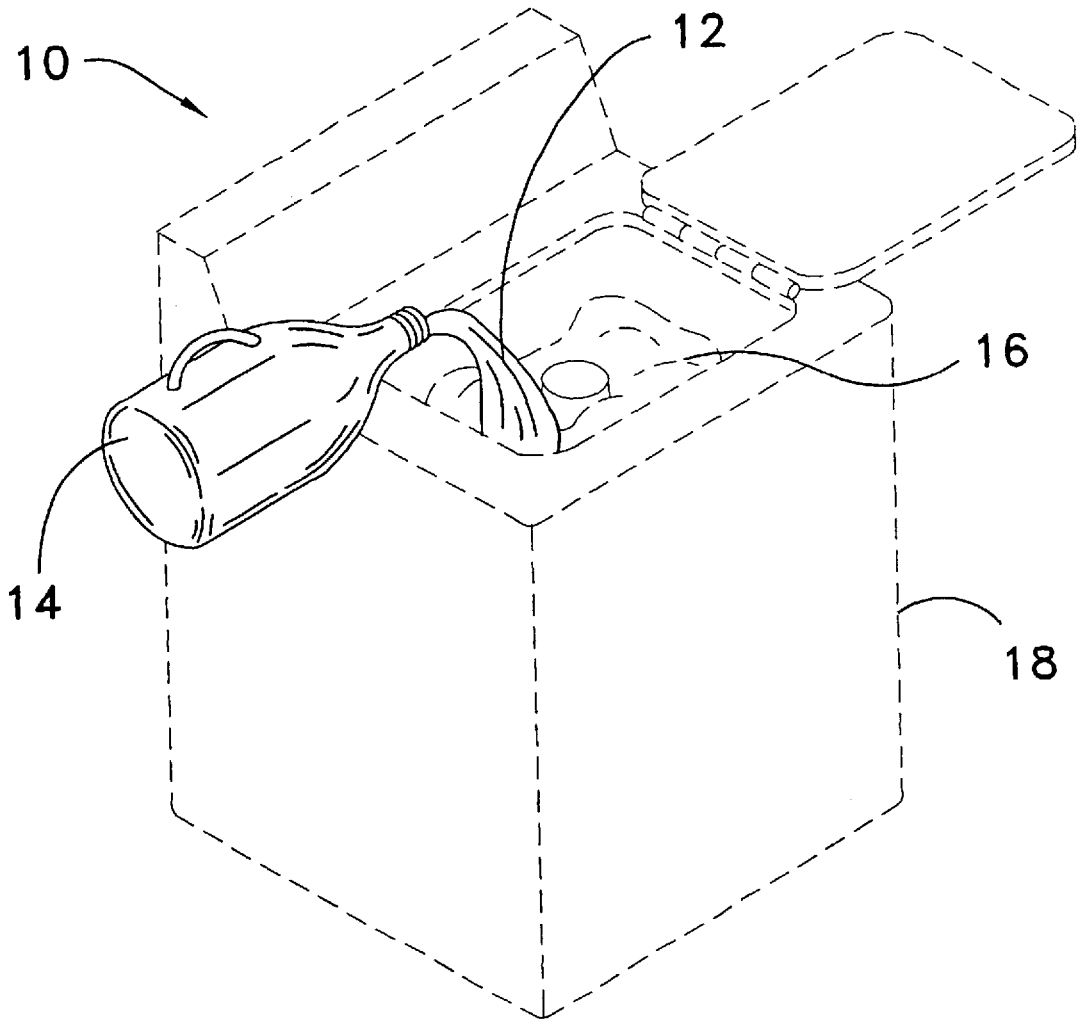
FIG. 1 is a schematic perspective view of a new method and apparatus for darkening black clothing according to the present invention.

With reference now to the drawings, and in particular to FIG. 1 thereof, a new method and apparatus for darkening black clothing embodying the principles and concepts of the present invention and generally designated by the reference numeral 10 will be described.

As best illustrated in FIG. 1, the method and apparatus for darkening black clothing 10 generally comprises a mixture 12 for use in preventing the fading, or darkening faded black articles of clothing. The mixture 12 includes black dye, sodium chloride salt (table salt), and water. Such a dye may be found under the trade name RIT dye produced by Unilever Bestfoods, P O Box 68, London EC4P 4BQ, United Kingdom. The salt used is preferably a processed sea-salt having a 99.9% or greater sodium chloride content to reduce caking of the salt.

The mixture 12 is preferably made by mixing together the black dye, the salt and the water together in a ratio of 40%–50% black dye, 40%–50% water, and 5%–15% salt by volume to define the mixture. Ideally, the mixture contains 45% dye, 45% water and 10%. Also, it is preferred that the water has a temperature of less than 20 degrees Celsius. The mixture 12 is then placed in a container 14 for later use.

In use, garments 16 which are faded, or are in danger of fading, are placed into a washing machine 18. Approximately 1⅛ cups of the mixture 12 is poured onto the garments 16 and the garments washed. Ideally, the mixture 12 is placed into the washing machine 18 during the bleaching cycle, which is when the washing machine 18 has filled with water. Many conventional washing machines have a port for depositing bleach into such that the bleach is emptied into the washing machine at the correct time. The user may place the mixture 12 into the port instead of the bleach. The salt helps the clothing to retain the dye.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of darkening faded garments comprising the steps of:

providing a quantity of dyeing mixture;

selecting garments to be darkened;

placing selected garments into a conventional washing machine;

selecting a wash cycle for the conventional washing machine;

placing a quantity of said dyeing mixture into a bleach compartment of the conventional washing machine; and allowing the conventional washing machine to complete the selected cycle normally.

2. The method of claim 1, wherein said step of selecting a wash cycle further includes the step of selecting a water temperature less than 20 degrees Celsius.

3. The method of darkening faded garments as in claim 1, wherein said mixture includes a ratio of 45% black dye, 45% water, and 10% salt by volume.

4. The method of darkening faded garments as in claim 1, wherein said mixture includes a ratio of 40% to 50% black dye, 40% to 50% water, and 5% to 15% salt by volume.

5. The method of claim 1, wherein said step of placing a quantity of said dyeing mixture into a bleach compartment further comprises place one cup of said dyeing mixture into the bleach compartment.

6. A method of darkening faded garments comprising the steps of:

providing a quantity of dyeing mixture in a container;

selecting garments to be darkened;

placing selected garments into a conventional washing machine;

selecting a wash cycle for the conventional washing machine;

selecting a water temperature less than 20 degrees Celsius;

placing approximately one and one eighth cups of said dyeing mixture into a bleach compartment of the conventional washing machine; and allowing the conventional washing machine to complete the selected cycle normally.

7. The method of darkening faded garments as in claim 6, wherein said mixture includes a ratio of 45% black dye, 45% water, and 10% salt by volume.

8. The method of darkening faded garments as in claim 6, wherein said mixture includes a ratio of 40% to 50% black dye, 40% to 50% water, and 5% to 15% salt by volume.

* * * * *